US007931362B2

(12) United States Patent
Burke

(10) Patent No.: US 7,931,362 B2
(45) Date of Patent: Apr. 26, 2011

(54) SYSTEM FOR CONTROLLING ENGAGEMENT OF A TRANSFIX ROLLER WITH AN IMAGE RECEIVING MEMBER IN A PRINTER

(75) Inventor: Edward Francis Burke, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 955 days.

(21) Appl. No.: 11/827,758

(22) Filed: Jul. 13, 2007

(65) Prior Publication Data

US 2009/0015645 A1 Jan. 15, 2009

(51) Int. Cl.
*B41J 2/01* (2006.01)

(52) U.S. Cl. ..... 347/103; 101/218; 101/247

(58) Field of Classification Search ..... 347/103; 101/218, 247

See application file for complete search history.

(56) References Cited

U.S. PATENT DOCUMENTS 4,539,854 A 9/1985 Bradshaw et al.
4,936,215 A * 6/1990 Walker et al. ..... 101/486
5,121,139 A * 6/1992 Burke ..... 346/138
5,134,939 A * 8/1992 Borne ..... 101/350.3
6,585,368 B1 7/2003 Park
2005/0252204 A1* 11/2005 Sekiguchi et al. ..... 60/435
2007/0103531 A1 5/2007 Jones et al.
2010/0194216 A1* 8/2010 Davis ..... 310/49.01

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

A hydraulic system controls engagement of a transfix roller with an image receiving member in a printer. The system includes a motor having an output shaft, a translational member having a first end and a second end, one of the first and the second ends being mechanically coupled to the output shaft of the motor so the motor output shaft moves the translational member in a linear path, a hydraulic translator coupled to the other end of the translational member so movement of the translational member in the linear path displaces hydraulic fluid within the hydraulic translator to move a pair of links in a linear direction, a transfix roller having a first end and a second end, the first and the second ends of the transfix roller being mechanically coupled to the pair of links so the displacement of the hydraulic fluid within the hydraulic translator moves the transfix roller in the linear direction for movement towards and away from an image receiving member, and a controller electrically coupled to the motor to send a motor control signal to the motor for controlling direction and speed of the motor output shaft.

9 Claims, 5 Drawing Sheets

SYSTEM FOR CONTROLLING ENGAGEMENT OF A TRANSFIX ROLLER WITH AN IMAGE RECEIVING MEMBER IN A PRINTER

TECHNICAL FIELD

The system described below relates to printers in which an image is transferred from an image receiving surface to a recording medium, and, more particularly, to printers in which the image is transferred to the recording medium as the medium passes through a nip between a transfix roller and an image receiving member.

BACKGROUND

Modern printers use a variety of inks to generate images from data. These inks may include liquid ink, dry ink, also know as toner, and solid ink. So-called "solid ink" refers to ink that is loaded into a printer as a solid, which is typically in stick or pellet form. The solid ink is melted within the printer to produce liquid ink that is supplied to a print head for ejection onto media or an intermediate member to generate a printed image from image data. These solid ink printers typically provide more vibrant color images than toner or liquid ink jet printers.

A schematic diagram for a typical solid ink imaging device is illustrated in FIG. 1. The solid ink imaging device, hereafter simply referred to as a printer 110, has an ink loader 112 that receives and stages solid ink sticks. The ink sticks progress through a feed channel of the loader 112 until they reach an ink melt unit 120. The ink melt unit 120 heats the portion of an ink stick impinging on the ink melt unit 120 to a temperature at which the ink stick melts. The liquefied ink is supplied to one or more print heads 130 by gravity, pump action, or both. Printer controller 180 uses the image data to be reproduced to control the print heads 130 and eject ink onto a rotating print drum or image receiving member 140 as image pixels for a printed image. Media 170, such as paper or other recording substrates, are fed from a sheet feeder 160 to a position where the image on the drum 140 can be transferred to the media. To facilitate the image transfer process, the media 170 are fed into a nip between the transfer, sometimes called transfix, roller 150 and the rotating print drum 140. In the nip, the transfix roller 150 presses the media 170 against the print drum 140. An assembly 190 of lever arms, camshafts, cams, and gears urged into motion by an electrical motor responds to signals from the controller 180 to move the transfix roller into and out of engagement with the print drum 140. Offset printing refers to a process, such as the one just described, of generating an ink or toner image on an intermediate member and then transferring the image onto some recording media or another member.

In previously known printers, the transfix roller is moved into and out of engagement with the print drum by the operation of stepper motors coupled to the transfix roller through cams, levers, and/or other force multiplying devices that require a fulcrum or the like. The motor force needed to move moment arms capable of producing 600 to 2200 pounds of total transfix force is substantial. In some cases, more than one motor is required for reliable operation of the transfix roller. Additionally, the cams and levers may also require bearings and springs for proper operation. These mechanical force multiplying components require lubrication and periodic inspection to ensure they are aligned correctly. Noise may also arise from the frictional engagement of the parts with one another. The mechanical interaction of these parts may also limit the speed at which the parts may be moved as repeated movement at faster speeds necessary for higher throughput rates may subject the mechanical parts to higher temperatures and affect the operational life of the components. Consequently, a quieter and simpler mechanism for moving a transfix roller is needed.

SUMMARY

A hydraulic system controls engagement of a transfix roller with an image receiving member in a printer. The system includes a motor having an output shaft, a translational member having a first end and a second end, one of the first and the second ends being mechanically coupled to the output shaft of the motor so the motor output shaft moves the translational member in a linear path, a hydraulic translator coupled to the other end of the translational member so movement of the translational member in the linear path displaces hydraulic fluid within the hydraulic translator to move a pair of links in a linear direction, a transfix roller having a first end and a second end, the first and the second ends of the transfix roller being mechanically coupled to the pair of links so the displacement of the hydraulic fluid within the hydraulic translator moves the transfix roller in the linear direction towards and away from an image receiving member, and a controller electrically coupled to the motor to send a motor control signal to the motor for controlling direction and speed of the motor output shaft.

The transfer roller control system may be incorporated in a printer. Such a printer includes a frame and an image receiving member rotatably secured to the frame. The printer also includes a print head for applying print to the print drum to form an image on the print drum and a transfix roller. The transfix roller has a first end and a second end. The transfix roller cooperates with the image receiving member to form a nip between the transfix roller and the image receiving member. The printer also includes a feeder for advancing media into the nip and a system for controlling engagement of the transfix roller with the image receiving member in the printer. The system includes a motor having an output shaft and a translational member having a first end and a second end. One of the first and the second ends is mechanically coupled to the output shaft of the motor so the motor output shaft moves the translational member in a linear path. The system also includes a hydraulic translator coupled to the other end of the translational member so movement of the translational member in the linear path displaces hydraulic fluid within the hydraulic translator to move a pair of links in a linear direction. The first and the second ends of the transfix roller are mechanically coupled to the pair of links so the displacement of the hydraulic fluid within the hydraulic translator moves the transfix roller into and out of engagement with an image receiving member. The system also includes a controller electrically coupled to the motor to send a motor control signal to the motor for controlling direction and speed of the motor output shaft.

BRIEF DESCRIPTION OF THE DRAWINGS

Features of the transfer roller control system are apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a system that rotates the transfix roller in solid ink printers, the system may be used with any printer that uses a belt or roller to assist in transferring the image to media. In particular, the system may be well suited for use in selectively engaging a fuser roll into and out of engagement with an image receiving member of a printer using toner.

Figure 1:
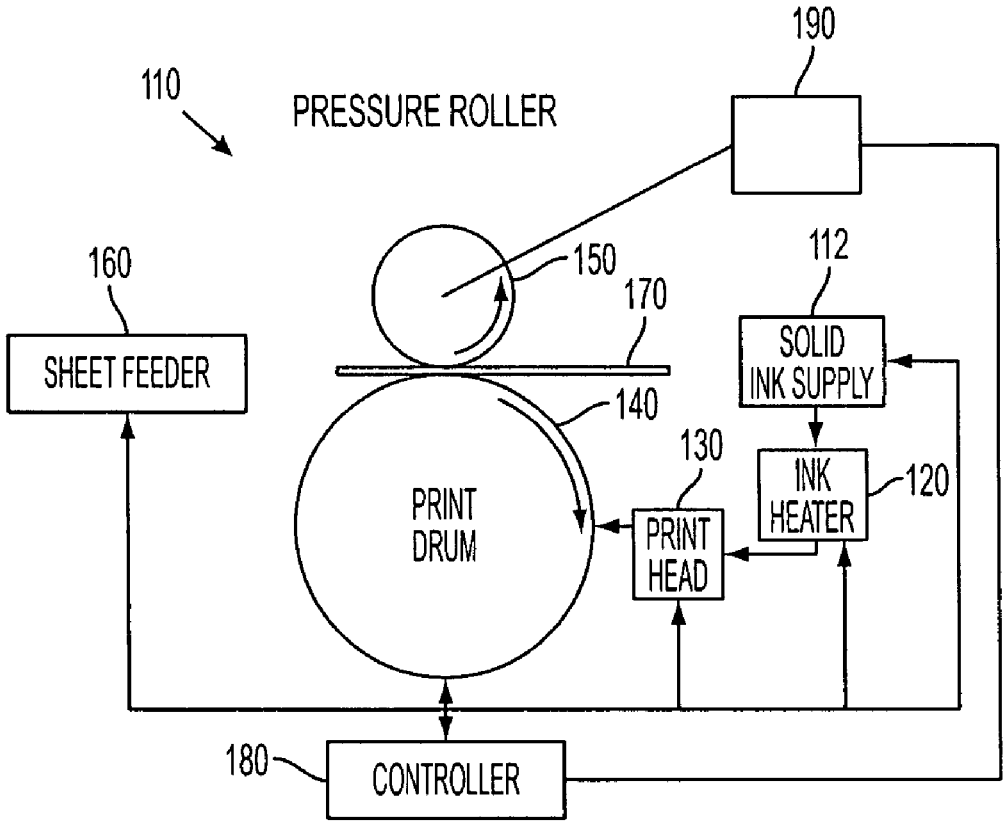
FIG. 1 PRIOR ART
FIG. 1 is a general schematic diagram of a printer including an image receiving member and a transfix roller.
Figure 2:
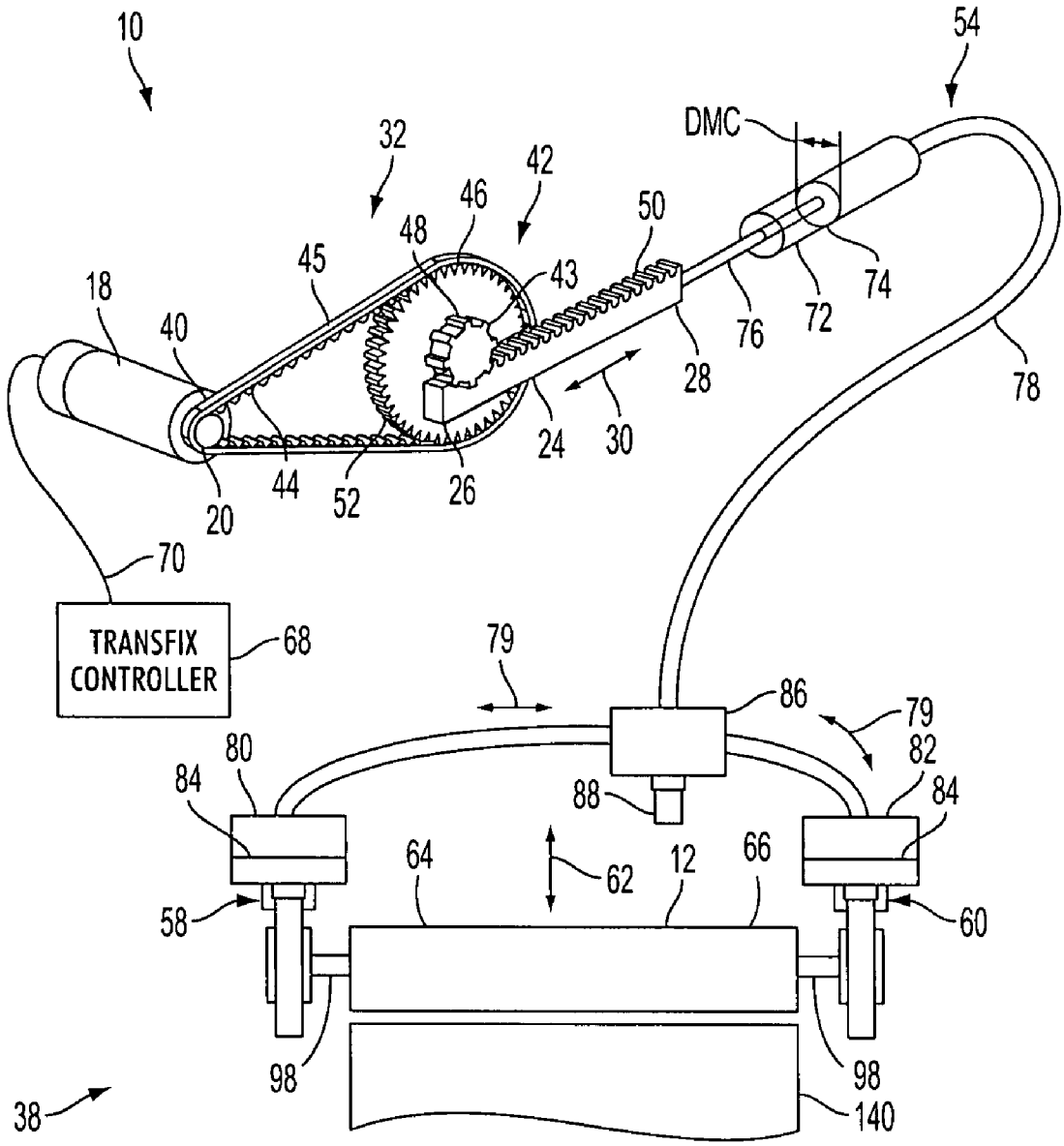
FIG. 2 is a general schematic diagram of a transfix roller control system for use in the printer of FIG. 1.

A system 10 for controlling engagement of a transfix roller 12 with an image receiving member 140 in a printer 16 is shown in FIG. 2. The system 10 includes a motor 18, which has an output shaft 20. The motor 18 may be any motor capable of rotating output shaft 20. The motor 18 is an electrical motor that is selectively coupled to a power source for rotation of the output shaft 20. The power source, not shown, may be either AC or DC. DC power is provided by transforming and rectifying AC power in a known manner. The motor 18 may be a positioning motor, such as a DC servo or stepper motor. By providing a speed reducer, as explained below, accurate control of the DC servo motor 18 need not be as precise as that required for an equivalent linear positional system. A standard electric motor may work in this application if the rotational speed is low and if the motor is adapted to stop abruptly. Position of the output shaft and the speed at which the shaft is moved is controlled by a motor control signal 70 from a controller 68. The motor 18 may include a motor control circuit and the motor control signal conforms to the manufacturer's specification for control of the motor.

While the motor described in the exemplary embodiment shown in the figures is a motor producing rotational output power, other types of motors may be used as well. For example, a motor producing a linear reciprocating output may be used. In such an embodiment, the motor may directly drive the piston of the master cylinder or a linear force linkage that drives the piston of the master cylinder.

The system 10 incorporates a motor that provides rotational output and further includes a translational member 24 having a first end 26 and an opposed second end 28. The first end 26 is mechanically coupled to the output shaft 20 of the motor 18 so that rotation of the motor output shaft 20 moves the translational member 24 in a linear direction, for example, along the direction of arrows 30. The translational member 24 may be any member capable of converting the rotation of output shaft 20 into linear motion. As shown in FIG. 2, the translational member 24 is in the form of a rack. Alternatively, the translation member may be a follower that cooperates with a cam mounted onto motor shaft. For example, the translation member may be a scotch yoke mechanism.

To permit the rotation of the output shaft 20 of motor 18 with improved linear speed control of the rack 24, a speed reducer 32 is positioned between the output shaft 20 and rack 24 such that the linear motion of the rack 24 may be optimized. Alternatively, the rack 24 may be moved in the direction of arrows 30 by a direct connection (not shown) of the rack 24 to the output shaft 20. The speed reducer 32 may, as shown in FIG. 2, be a motor timing pulley or motor gear 40, which is connected to output shaft 20 of the motor 18. The motor timing pulley 40 is coupled to pinion gear 42, as described in more detail below, so rotation of pulley 40 rotates pinion gear 42 to translate rack 24 in the direction of arrows 30. The pinion gear 42 includes a first cylindrical structure or small gear 43, which includes teeth 48 that mesh with teeth 50 on rack 24. The pinion gear 42 is operatively coupled to the motor timing pulley 40 by, for example, a timing belt 44 having teeth 45 which engage the motor timing pulley 40 as well as with a second cylindrical structure or large timing pulley 46 on pinion gear 42.

The speed reducer 32 serves to reduce the rotational speed of output shaft 20 so the first cylindrical structure 43 rotates at a rotational speed that is less than that of the output shaft 20 of the motor 18. For example, the second cylindrical structure 46 may have a diameter that is larger than the diameter of the motor timing pulley 40. The speed reduction ratio may be described as ratio of the diameters of the pinion gear and the motor pulley, and may, for example, be around four to eight, or perhaps six. The use of a timing belt 44 having teeth 45 to engage the teeth on the motor timing pulley 40 and the teeth 52 on the pinion gear 42 provides very accurate angular positioning of the pinion gear 42 with respect to the output shaft 20. In particular, slippage and other inaccuracies in rotational speed may be limited. The timing belt 44, however, may be replaced with a toothless belt and the motor timing pulley 40 and the pinion gear 42 may be replaced with pulleys. For example, the belt may be in the form of flat or V-type belt that rides in a groove around the circumference of a pulley.

Referring again to FIG. 2, the system 10 includes a hydraulic translator 54 coupled to the second end 28 of the rack 24. The hydraulic translator 54 utilizes movement of the translation member 24 in the linear path 30 to displace hydraulic fluid within the hydraulic translator 54. The hydraulic translator 54 includes a pair of links 58 and 60. The displacement of the hydraulic fluid within the hydraulic translator 54 linearly moves the links 58 and 60. For example, the links 58 and 60 may be moved in the linear direction 62. The system 10 is coupled to a transfix roller 12 by the links 58 and 60. The transfix roller 12 has a first end 64 and a second end 66. The first end 64 and the second end 66 of the transfix roller 12 are mechanically coupled to the links 58 and 60, respectively. Consequently, displacement of the hydraulic fluid 56 within the hydraulic translator 54 moves the transfix roller 12 towards and away from the image receiving member 14 along arrows 62.

The hydraulic translator 54 may have any suitable form capable of providing hydraulic fluid 56 to move the links 58 and 60 in the direction of arrows 62. For example, and as shown in FIG. 2, the hydraulic translator 54 includes a master cylinder 72 and a pair of slave cylinders 80 and 82. The master cylinder 72 includes an internal cavity having a first diameter DMC. The master cylinder 72 further includes a piston 74 having the first diameter DMC which slides within the internal cavity of the master cylinder 72. The piston 74 is coupled to rack 24 at second end 28 of the rack 24 and may be coupled to the piston 74 in any suitable fashion. For example, the rack 24 may be coupled in a rigid fashion by a cylindrical shaft 76, which extends from the piston 74 to the second end 28 of the rack 24. Movement of the rack caused by rotation of the motor reciprocates the shaft 76 and piston 74 within the internal cavity of the master cylinder 72 along linear path 30. The reciprocating movement of the piston 74 displaces hydraulic fluid 56 within the master cylinder 72. Fluid urged out of the master cylinder 72 flows through the conduit 78 to a manifold 86, which evenly distributes the displaced hydraulic fluid 56 between the master cylinder 72 and the slave cylinders 80 and 82. The conduit 78 hydraulically connecting the master cylinder to the slave cylinders may be in the form of solid or flexible hydraulic hoses.

The hydraulic translator 54 of the system 10, as shown in FIG. 2, includes a pair of slave cylinders 80 and 82. In the exemplary embodiment shown in the figures, the slave cylinders are depicted as diaphragm cylinders, although other types of slave cylinders may be used to multiply hydraulically the force output by the master cylinder. Each of the slave cylinders 80 and 82 has a second diameter (DS), which may be substantially larger than the diameter DMC of the master cylinder 72. The fluid displaced in master cylinder 72 must be shared between the first slave cylinder 80 and the second slave cylinder 82. Thus, a two to one mechanical advantage exists if the diameter of the master cylinder is the same as the diameter of the slave cylinders 80 and 82. If the diameters of the slave cylinders 80 and 82 are larger than the diameter DMC of the master cylinder 72, further mechanical advantage is available. For example, the mechanical advantage of the hydraulic translator 54 is equal to $2\times(DS)^2/(DMC)^2$. For example, a ratio of DS to DMC of 6 to 1, would result in a mechanical advantage of 72 to 1.

The slave cylinders 80 and 82 are in fluid communication with the master cylinder 72 by the conduit 78. Each of the slave cylinders 80 and 82 has a piston, for example, pistons 84. The slave cylinders 80 and 82 may be secured to the frame for the printer 16 for proper support. One end 83 of a piston 84 reciprocates within the slave cylinders 80 and 82 in response to the displacement of a diaphragm 99 (FIG. 3) caused by the hydraulic fluid 56 moved by the piston within the master cylinder 72. The other end 85 of the pistons 84 in each slave cylinder 80 and 82 are mechanically coupled to the transfix roller 12 by the links 58 and 60.

While the hydraulic translator 54 has been described as having a pair of slave cylinders 80 and 82, an embodiment having a solitary slave cylinder (not shown) with a mechanical linkage (not shown) may be used to move the transfix roller 12 with links 58 and 60. The mechanical linkage to connect the solitary slave cylinder would need to be adapted to provide equal force on each of the links such that the transfix roller 12 is evenly and uniformly moved towards and away from the image receiving member 140.

The system 10 may further include a transducer 88 in fluid communication with the hydraulic fluid within the hydraulic translator 54. The transducer 88 is utilized for generating an electronic signal corresponding to a pressure of the hydraulic fluid 56. The signal is received by, for example, the controller 68. As shown in FIG. 2, the controller 68 is utilized to generate the motor control signal 70 to rotate motor 18 and then to move the piston 74 of the master cylinder 72 a distance to obtain the desired pressure of the hydraulic fluid 56. The electrical pressure signal from the transducer enables the controller 68 to move the transfix roller quickly. In one embodiment, the response time of the controller was able to move the transfix roller into and out of engagement with an image receiving member within 50 milliseconds. The transducer 88 may be any pressure transducer suited for the printer application and may be a strain gauge transducer.

Figure 3:
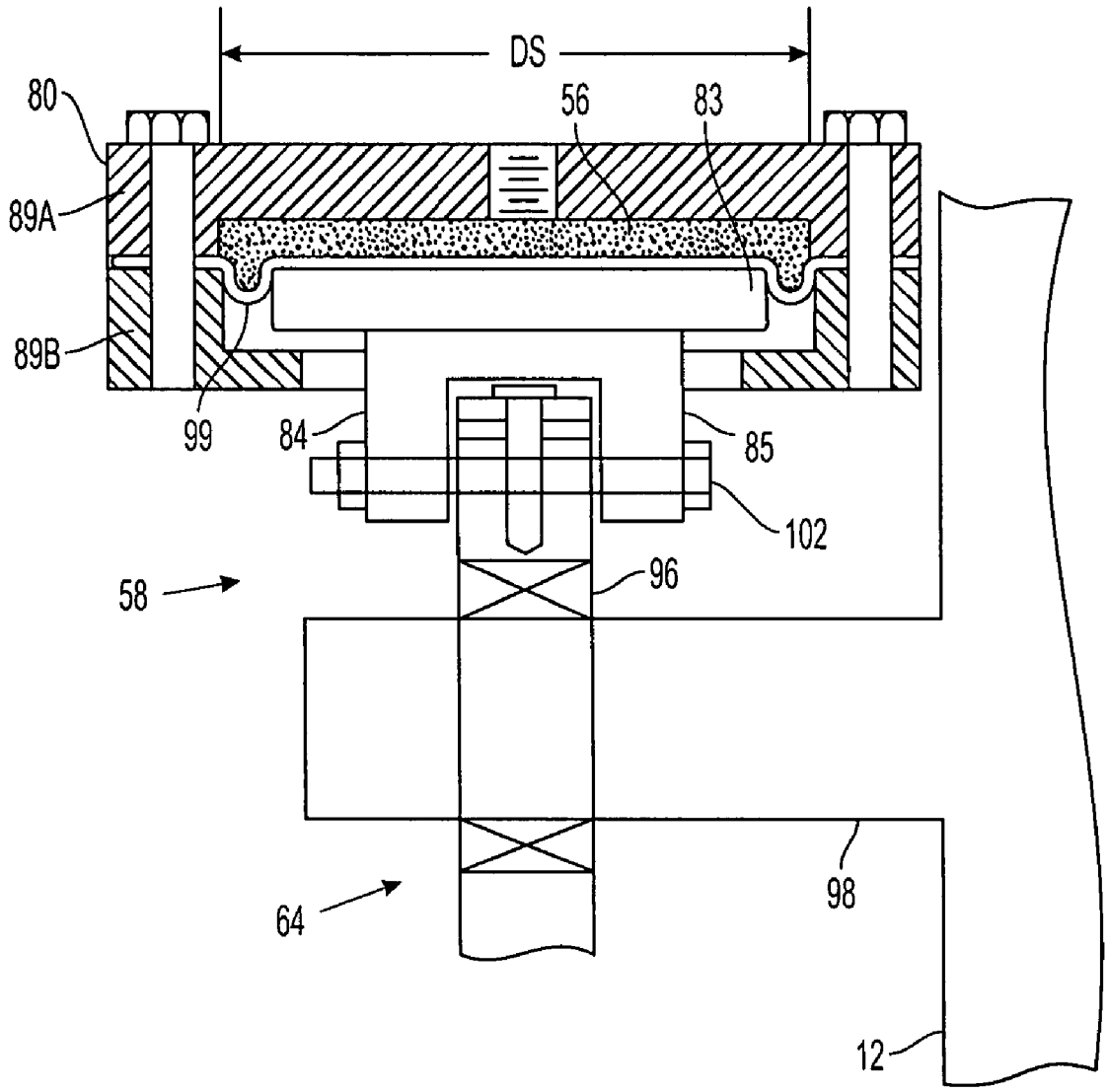
FIG. 3 is a partial plan view of the system of FIG. 2 showing a slave cylinder of the hydraulic translator in greater detail.

The links 58 and 60 may have any suitable shape. As shown in FIG. 3, the slave cylinder 80 may be formed by connecting cylinder half 89A to cylinder half 89B with fasteners. Sandwiched between the two cylinder halves is a diaphragm 99, which is made from a flexible material having a suitable resiliency with hydraulic fluid. The diaphragm 99 seals the slave cylinder so hydraulic fluid does not escape from the cylinder. In response to hydraulic fluid pushing the diaphragm towards the piston 84, the U-shaped bracket extending from the bottom of piston 84 moves in a linear direction. Link 60 may be constructed in a similar manner for operation in the same way.

Figure 4:
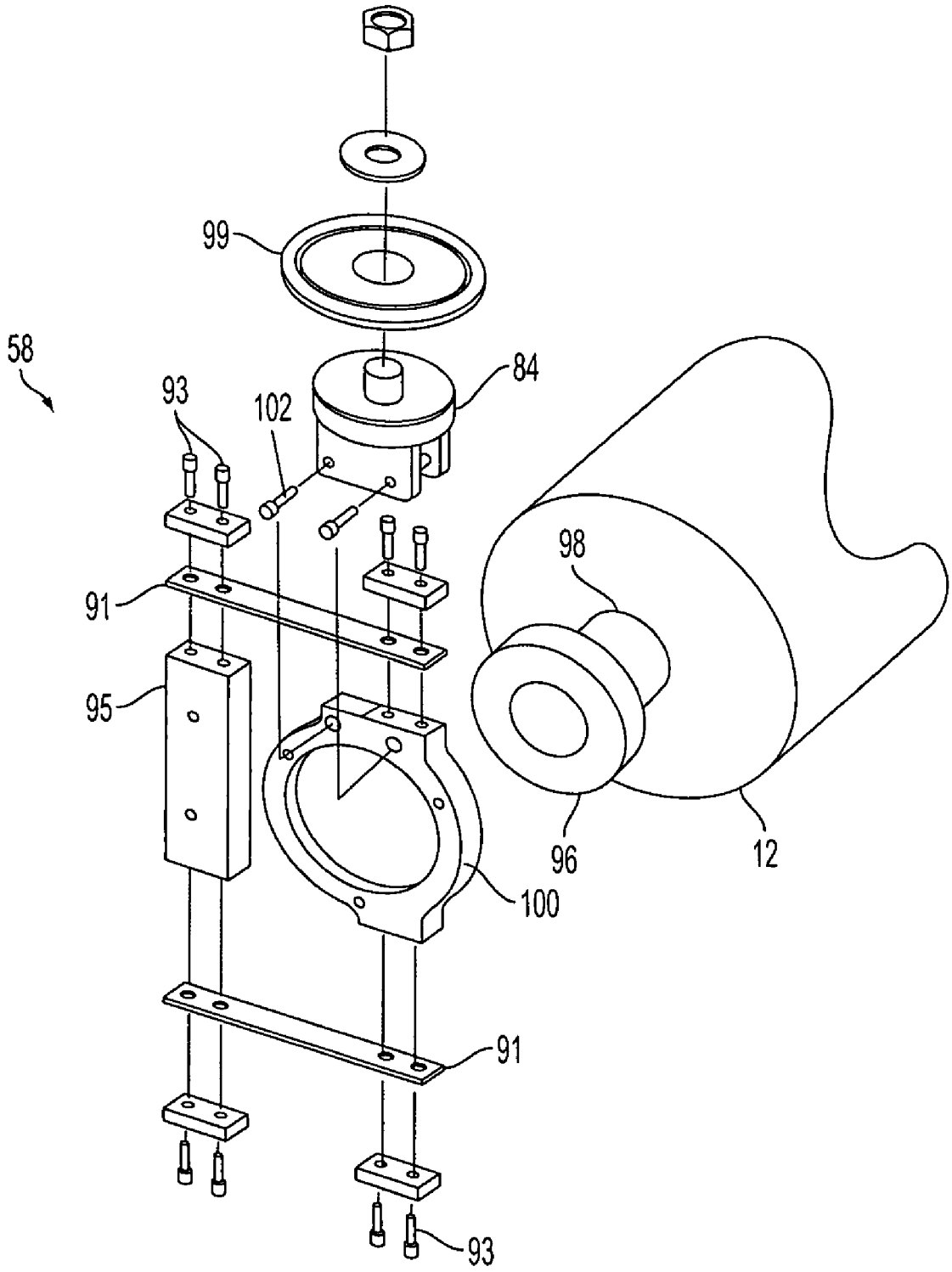
FIG. 4 is a partial exploded perspective view of the slave cylinder of FIG. 3.
Figure 5:
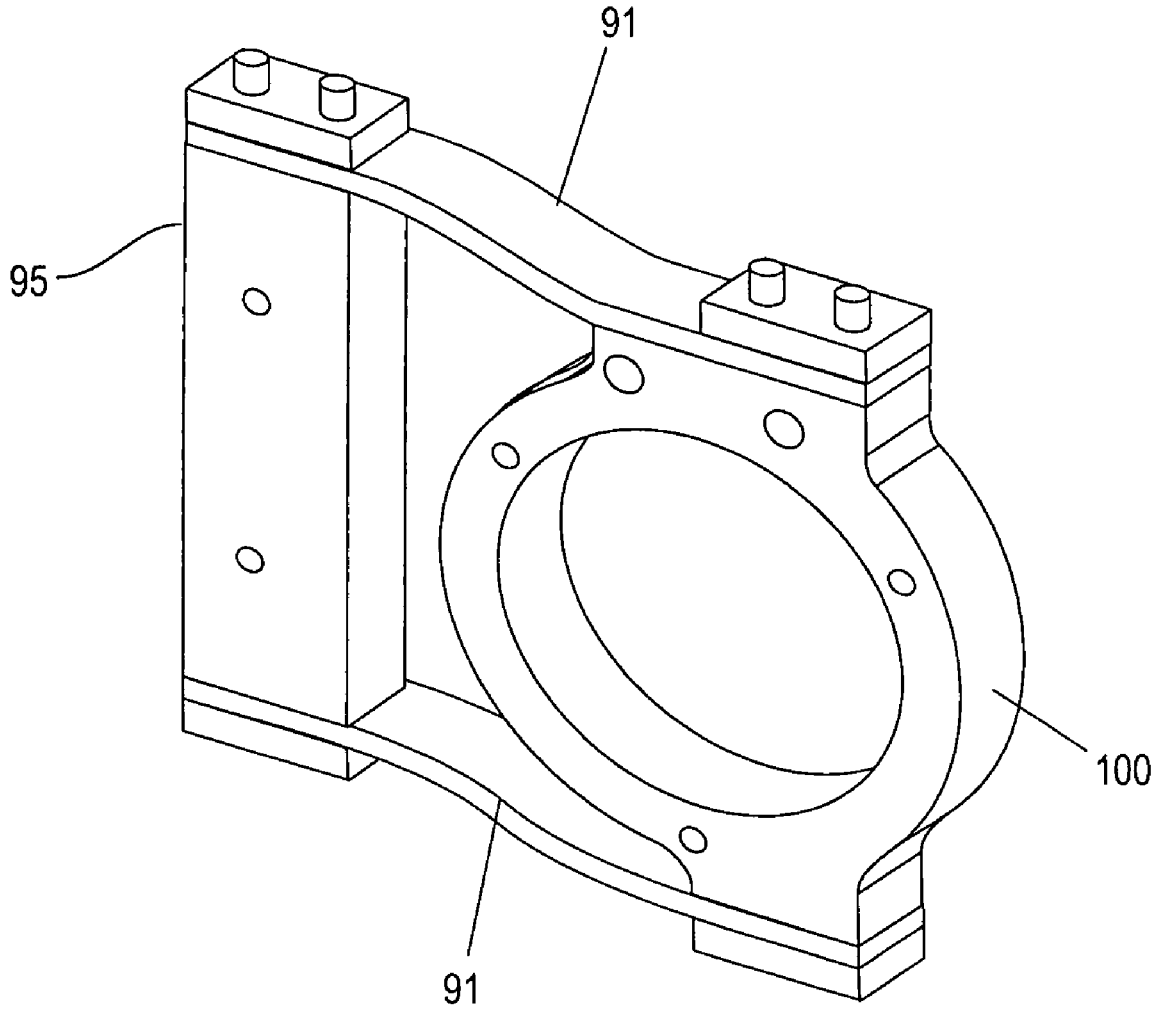
FIG. 5 is a perspective view of the flexures shown in FIG. 4.

FIG. 4 shows an exemplary coupling of the end 64 of the transfix roller 12 to the link 58. Mounted within a collar 100 is a bearing 96. A shaft 98 extends along the longitudinal center line of the transfix roller 12 and fits within the bearing 96. The shaft 98 of the transfix roller 12 rotates within the bearing 96. Fasteners 102 connect the U-shaped bracket that extends from the piston 84 to the collar 100. This connection enables the link 58 to translate in response to movement of the piston 84 within the slave cylinder 80. Metal flexures 91 help ensure vertical movement of the transfix roller in a parallelogram pattern. The metal flexures may be made from spring steel or the like. A vertical stabilizer 95 is mounted between a first set of ends for the flexures and the other ends of the flexures are mounted to the collar 100. As shown in FIG. 5, the downward deflection of the piston 84 acting on the collar 100 causes the flexures 91 to bend in a S-shape. The illustration in FIG. 5 does not shown the connection of the piston 84 to the collar 100 to better demonstrate the bending of the flexures. This bending controls the roller movement and provides a spring bias acting as a return force on the transfix roller as the hydraulic pressure is released in the master cylinder. The link 60 is connected to the U-shaped bracket on the end 66 of the transfix roller 12 in a similar manner so that end translates in response to the displacement of hydraulic fluid in the slave cylinder 82.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printer for forming an image on media, said printer comprising:

a frame;

an image receiving member secured to the frame for rotation about a longitudinal axis;

a print head configured to eject ink onto the image receiving member to form an image on the image receiving member;

a transfix roller having a first end and a second end, said transfix roller being configured for movement with respect to the image receiving member to form selectively a nip between the transfix roller and the image receiving member;

a feeder configured to advance media into the nip;

a motor having an output shaft;

a translational member having a first end and a second end, one of the first and the second ends of the translational member being mechanically coupled to the output shaft of the motor to enable the motor output shaft to move the translational member in a linear path;

a hydraulic translator operatively connected to the other end of the translational member to enable movement of the translational member in the linear path to displace hydraulic fluid within the hydraulic translator and move a pair of links in a linear direction, the first and the second ends of the transfix roller being mechanically coupled to the pair of links to enable the displacement of the hydraulic fluid within the hydraulic translator to move the transfix roller in the linear direction for movement towards and away from the image receiving member; and a controller electrically coupled to the motor, the controller being configured to send a motor control signal to the motor to control a direction and speed of the motor output shaft.

2. The printer of claim 1 wherein the motor is a linear output motor and the translational member is a rack having a first end, a second end, and a plurality of teeth between the first and the second ends, one end of the rack being operatively connected to the hydraulic translator; and the printer further comprising:

a pinion gear having a first cylindrical structure with a plurality of teeth and a second cylindrical structure having a plurality of teeth, the teeth of the first cylindrical structure engaging the teeth of the rack; and a timing belt that engages the teeth of the second cylindrical structure of the pinion gear and that engages the output shaft of the motor to enable rotation of the output shaft of the motor to rotate the timing belt and the pinion gear and translate the rack in a linear direction to displace hydraulic fluid in the hydraulic translator.

3. The printer of claim 1, the hydraulic translator further comprising:

a master cylinder having a first diameter, the master cylinder having a piston that is operatively connected at one end to the rack to enable another end of the piston to reciprocate within the master cylinder to displace hydraulic fluid within the master cylinder; and a pair of slave cylinders, each slave cylinder having a second diameter that is different than the first diameter of the master cylinder and each slave cylinder being in fluid communication with the master cylinder, each slave cylinder having a piston with one end that reciprocates within the slave cylinder in response to the displacement of hydraulic fluid within the master cylinder and another end of the piston in each slave cylinder being mechanically coupled to one of the links coupled to the transfix roller.

4. The printer of claim 3 further comprising:

a manifold that is in fluid communication with the master cylinder and the two slave cylinders, the manifold distributing being configured to distribute the displaced hydraulic fluid between the master cylinder and the two slave cylinders.

5. The printer of claim 1 further comprising:

a transducer in fluid communication with the hydraulic fluid, the transducer generating an electrical signal corresponding to a pressure of the hydraulic fluid; and the controller being electrically coupled to the transducer, the controller being configured to receive the electrical signal from the transducer.

6. The printer of claim 3, the second diameter of each slave cylinder being substantially larger than the first diameter of the master cylinder.

7. The printer of claim 5, the controller being further configured to generate a motor control signal to move the piston in the master cylinder a distance corresponding to the pressure of the hydraulic fluid being an image transfer pressure.

8. The printer of claim 7, the controller being configured to generate a motor control signal to stop the translational member and the piston in the master cylinder in response to the controller receiving an electrical signal from the transducer corresponding to the pressure of the hydraulic fluid being the image transfer pressure.

9. The printer of claim 3, the end of each piston in each slave cylinder that is mechanically connected to a link having a U-shaped bracket into which one end of the link is coupled; and each link having a bearing in another end of each link that is configured to mount about a shaft extending from one end of the transfix roller to enable the shaft ends of the transfix roller to rotate within the bearings of the links to enable the links to translate in response to movement of each piston within the slave cylinders.

* * * * *